United States Patent [19]

Lucas

[11] Patent Number: 4,500,022

[45] Date of Patent: Feb. 19, 1985

[54] DEVICE FOR SEVERING BLANKS OF A BATCH OF DIE CUT SHEETS

[75] Inventor: Raymond Lucas, Prechac, France

[73] Assignee: Bobst SA, Lausanne, Switzerland

[21] Appl. No.: 495,582

[22] Filed: May 18, 1983

[30] Foreign Application Priority Data

May 19, 1982 [CH] Switzerland ..... 3143/82

[51] Int. Cl.[3] ..... B26F 3/02

[52] U.S. Cl. ..... 225/97; 83/103; 225/101; 493/82

[58] Field of Search ..... 225/97, 101, 2; 93/36 A; 83/103

[56] References Cited

U.S. PATENT DOCUMENTS

| | | | |
|---|---|---|---|
| 3,658,220 | 4/1972 | Norton | 225/97 X |
| 4,136,604 | 1/1979 | Schmidt | 225/101 X |
| 4,171,081 | 10/1979 | Vossen et al. | 225/97 |
| 4,175,686 | 11/1979 | Lang | 225/97 |

FOREIGN PATENT DOCUMENTS 2654000 5/1981 Fed. Rep. of Germany .

*Primary Examiner*—Frank T. Yost

*Attorney, Agent, or Firm*—Hill, Van Santen, Steadman & Simpson

[57] ABSTRACT

A device for processing a batch or stack of die cut sheets to sever the individual blanks into piles of blanks characterized by a lower frame supporting a fixed plate and a slidable plate, an upper frame movable relative to the lower frame supporting a fixed plate and a slidable plate, each of said fixed and slidable plates supporting a pair of transversely movable tables so that when a batch of die cut sheets is disposed between the movable tables and the upper frame is lowered, the movable tables can cause a separation of the blanks along two orthogonal directions. The device also includes a conveyor which is mounted in the frame for conveying the batch into the device and the piles out of the device with the conveyor being retracted as the upper frame is moved into clamping engagement with the batch of sheets.

9 Claims, 13 Drawing Figures

DEVICE FOR SEVERING BLANKS OF A BATCH OF DIE CUT SHEETS

BACKGROUND OF THE INVENTION

The present invention is directed to a device for severing various blanks from a batch of die cut sheets which were prepared in a platen press, for example.

A device for severing the blanks from a batch of die cut sheets is already known and an example is described in German Pat. No. 26 54 000. It comprises two punches which are positioned a certain distance from each other. A counterplate is facing each punch. The batch of the die cut sheets to be severed is inserted between the punches and the counterplates so that the severing lines lie approximately half-way between the axes of the pair of punches. The punches are then actuated so that two parts of the batch are clamped between the punches and their respective counterplates. One of the punch counterplate assemblies is then shifted away from the other punch counterplate assembly with the shifting consequently breaking the nicks, which interconnect the blanks, by pulling the two sections apart. After the punches have been elevated again, the batch of sheets is shifted forward to allow the positioning of a new batch with the severing line of the new batch being located between the two punch counterplate assemblies which are now ready to start a new severing operation. This method and apparatus only allows the severing of one group of blanks in a batch along a single line. To complete the severing of the blanks of the batch on another cut line require a rotation of the batch through an angle of approximately 90° and a reinserting of the batch between the two punches and their counterplate assemblies. The severing operation carried out by this device obviously has drawbacks when processing a batch of sheets which have more than two blanks per sheet. For example, if the blanks are arranged in rows and columns in the sheet, a row is first severed from the batch and then the blanks of the row need to be severed from each other by utilizing a second severing device similar to the above mentioned severing device. If there are more than two blanks in a row, danger of slowing down the output of the severing unit will occur because it is then impossible to separate the rows of blanks of each batch in the first station as long as the second station has not finished the process of separating the blanks of the row.

SUMMARY OF THE INVENTION

The present invention is directed to providing a device which avoids the need of two successive severing stations on the one hand and to suppress on the other hand the reprocessing of a row of blanks in a batch to be severed. In addition, the present invention provides a device which enables separating the blanks in the batch without modifying the direction of movement of the batch through the device.

To accomplish these goals, the present invention is directed to a device for severing the various blanks of a batch of die cut sheets. The device comprises a lower main frame having a pair of side frames with a lower transverse frame member or plate extending therebetween; an upper movable frame being connected on each side by an articulated parallelogram consisting of a pair of parallelly extending rods to the side frames of the lower frame, said upper main frame having an upper transverse frame member or plate, the transverse frame member of the upper movable frame and the transverse frame member of the lower frame each supporting a fixed plate and a slidable or movable plate, each of said fixed plates supporting two movable tables and each of said slidable plates supporting two movable tables, means for moving the movable tables away from each other, means for moving the slidable plates away from the fixed plates in their respective frames, means for moving the upper frame toward the lower frame to clamp a batch of sheets between said tables, and conveying means for moving a batch between said clamping tables.

Preferably, the movable tables on the lower fixed frame are provided with laterally spaced longitudinal elements which have a covering on their surface engaging the batch and have a sufficient space therebetween to enable belts from the conveyor means to pass therebetween. In a similar manner, the movable tables of the upper movable frame have pressure plates which are provided with a covering. Preferably, the conveyor means comprises belts which are mounted on a pulley arrangement in a frame connected to the upper movable frame so that as the upper movable frame is moved downward to engage a batch, the belts are withdrawn from engagement with the lower portion of the batch.

The means for shifting the movable or slidable plate from the fixed plate on both the upper and lower frame member as well as shifting the movable tables of the upper part and the lower frame parts comprise hydraulic double-acting piston arrangements. To guide each of the movable tables, preferably they are mounted in apertures formed either in the respective movable plate or fixed plate and have rollers engaging a surface of the plate for providing the horizontal guidance and also rollers engaging the edges of the apertures to provide the lateral guidance. Each of the movable plates has rollers riding on a track to provide horizontal guidance and also rollers engaging the edge of the track to provide lateral guidance. If desired, the means for moving such as hydraulic jacks can be displaced or offset from the theoretical medium axis of the device so that the plates and the tables are canted to move slightly out of a parallel arrangement to provide a tearing action.

BRIEF DESCRIPTION OF THE DRAWINGS

FIGS. 6*a* and 6*b* diagrammatically illustrate a severing operation of the blanks from a batch of sheets containing six blanks;

FIGS. 7*a*, 7*b* and 7*c* diagrammatically illustrate severing of the blanks of a different structure of a sheet forming the batch; and FIGS. 8*a*, 8*b* and 8*c* diagrammatically illustrate the steps of severing a batch of blanks having eight blanks to a sheet.

DESCRIPTION OF THE PREFERRED EMBODIMENTS

Figure 1:
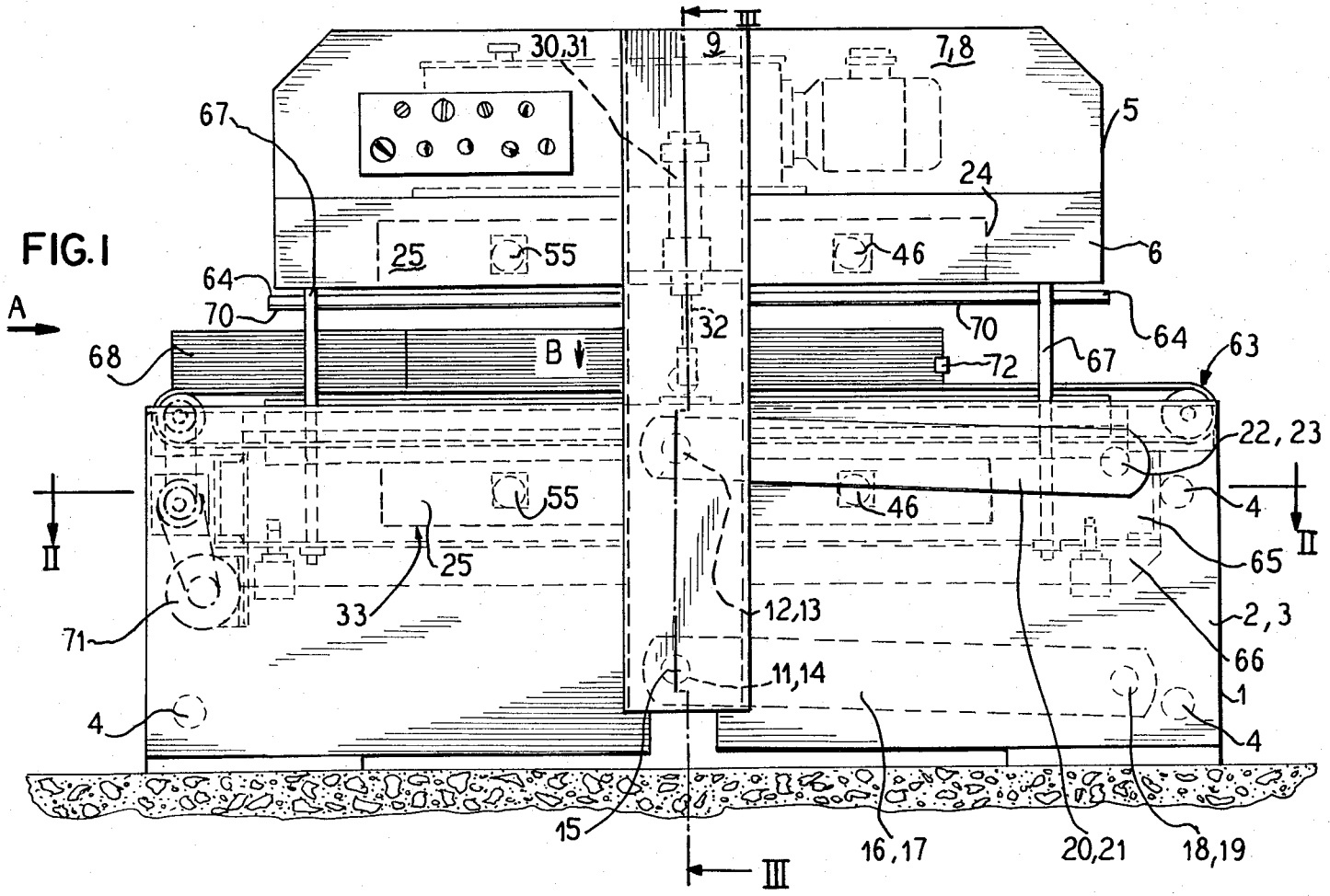
FIG. 1 is a side view of the device in accordance with the present invention.

The principles of the present invention are particularly useful in a device illustrated in FIG. 1, which device has a lower frame 1 with a pair of side frames 2 and 3 (FIG. 2) which are interconnected by cross members 4. A movable upper frame 5 composed of a pair of side frame members 7 and 8 interconnected by an upper transverse plate 6 has a pair of channel members 9 and 10 secured to the side plates 7 and 8, which channel members extend on the outside of the side frames 3 and 4. Each of the channel members of bars 9 and 10 have bearings 11, 12, 13 and 14 with the bearings 11 and 14 supporting the extremities of a shaft 15 on which lower connecting rods 16 and 17 are mounted. The other end of the connecting rods 16 and 17 are connected by bearings 18 and 19 to the lateral or side frames 2 and 3 of the lower frame 1. The bearings 12 and 13 provide pivotal connecting points for upper connecting rods 20 and 21, the other end of which is connected by bearings 22 and 23 to the lateral frames 2 and 3 of the lower frame 1. This assembly of the rods 16 and 17 and 20 and 23 as well as the channels 9 and 10 and the side frames 2 and 3 form a double articulated parallelogram which is located on each side of the lower frame 1 and insures a perfect guidance of the upper movable frame 5 during its vertical motion.

Figure 3:
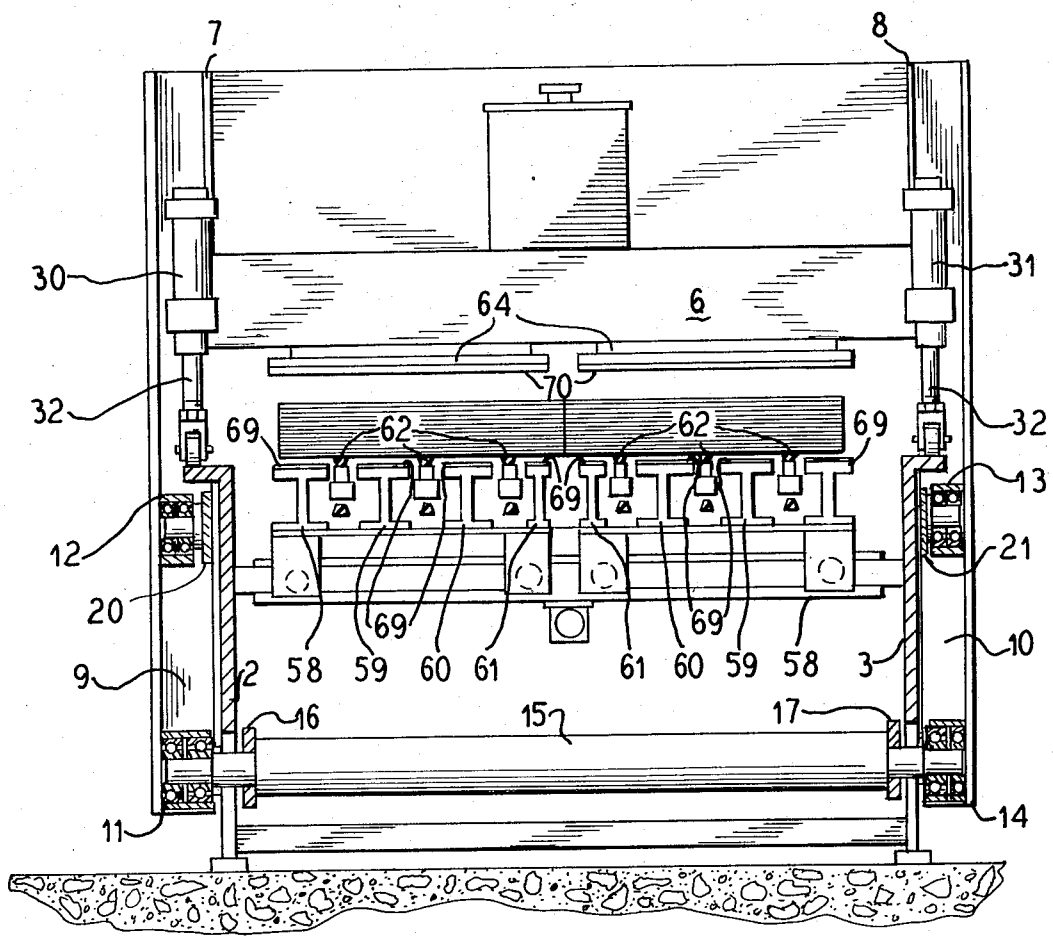
FIG. 3 is a cross-sectional view taken on lines III—III of FIG. 1.

The transverse plate or upper plate 6 supports a sliding or movable plate 24 and a fixed plate 25 with the fixed plate 25 supporting two movable tables 28 and 29 while the sliding plate 24 supports movable tables 26 and 27. In order to shift the movable frame 5 relative to the fixed frame 1, two jacks or pistons 30 and 31 are located in each side of the upper movable frame 5 within the channel members 9 and 10. The jacks 30 and 31 are double-acting pistons which are permanently connected to the upper transverse plate 6 and have their piston rods 32 engaged on an upper surface of each of the side frames 2 and 3 of the lower frame 1 as best illustrated in FIG. 3. Thus, the pistons or jacks 30 and 31 can raise and lower the movable upper frame 5 relative to the fixed frame.

Figure 2:
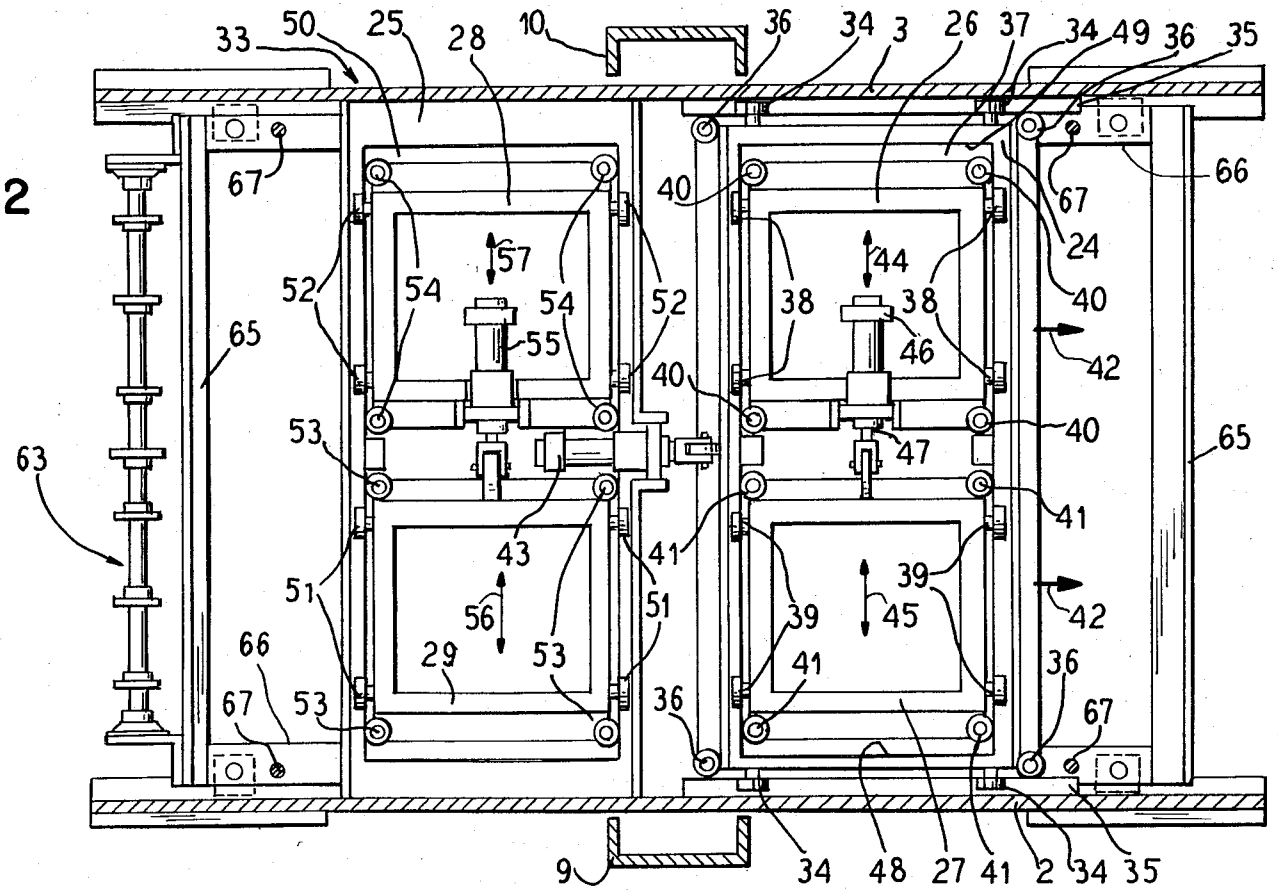
FIG. 2 is a cross-sectional view taken on lines II—II of FIG. 1.

The lower frame 1 has a lower transverse frame plate 33 best illustrated in FIG. 2 which supports a sliding or movable plate 24 and a fixed plate 25 which coact with the plates 24 and 25 of the upper frame. The sliding plate 24 has lateral rollers 34 which ride on a track 35 which is secured to each of the side frames 2 and 3 and insure the horizontal guiding of the sliding plate. The lateral guiding of sliding plate 24 is obtained by rollers 36 which engage the edge of the track or slider 35. The sliding plate 24 like the sliding plate 24 of the upper frame supports two movable tables 26 and 27 which are arranged in an opening or aperture 37. The horizontal guiding is obtained by rollers 38 and 39 connected to the tables which ride on a surface of the plate 24. Each of the movable tables 26 and 27 is guided laterally by rollers 40 and 41 which engage a rolling path which is formed by an edge surface of the opening 37. The movement of the sliding plate 24 in the direction of the arrows 42 is obtained by a double-acting jack or piston 43 and the shifting of the movable tables 26 and 27 in a direction of the double arrows 44 and 45 is obtained by a double-acting piston 46 whose cylinder is connected to the table 26 and its piston rod 47 is connected to the table 27. The axis of the jacks or pistons 43 and 46 may be slightly offset from the medium or center line of the respective slidable plate 24 and the tables 26 and 27 so that as the tables and/or sliding plate 24 are moved in their directions such as 44, 45 and 42, respectively, a slight canting will occur to create a tearing effect in the severing area. In this case, a certain gap between the rollers such as 34, 40 and 41 and their respective paths is provided so that the movable tables can form a slight angle with regard to the theoretical shifting axis. This canting of the tables will produce a progressive tearing action in a way similar to the tearing-off of the sheet in a block. During actuation of the piston 46 with the rod 47, the initial movement will shift the table 27 against an edge 48 of the aperture 37 in the sliding plate 24. Continual movement of the piston will then shift the table 26 against an edge 49 opposite to the edge 48.

The fixed plate 25 also has an aperture 50 and the two other movable tables 28 and 29 are mounted on the fixed plate with rollers 51 and 52 engaging the surface of the plate 25 adjacent the aperture 50 while rollers 53 and 54 ride on the edge of the aperture to guarantee the lateral guidance. Means are provided for moving the tables 28 and 29 which is a double-acting hydraulic cylinder 55 which is secured on the table 28 and has a piston rod secured to the plate 29. As with regard to the mounting of the pistons 43 and 46, the piston 45 can also be mounted slightly offset from the center line of the tables 28 and 29. It should be noted that the plates 24 and 25 in the upper frame are constructed in exactly the same manner so that the tables such as 26 and 27 as well as 28 and 29 are aligned with each other and will move together.

As best illustrated in FIG. 3, each of the tables 26, 27, 28 and 29 on a surface supports laterally spaced longitudinal elements 58, 59, 60 and 61. These elements 58–61 are separated from each other just enough to allow passage of belts 62 of a lower conveyor 63 which is best illustrated in FIGS. 1 and 3. The space between these longitudinal elements 58–61 must be positioned so that when the movable plates 26–29 are shifted in the direction of the arrows 44, 45 and 56 and 57, they will not engage the belt 62 of the lower conveyor 63. The movable plates 26–29 which are located on the movable upper frame 5 are each preferably provided with a pressure plate 64 which totally covers their surface. The pressure plate 64 will correspond to the outline formed by the longitudinal elements 58–61 of the table on the lower frame.

The conveyor 63 (see FIGS. 1 and 4) is mounted on a transverse bar 65 which is connected to side bars such as 66 to form a frame which is linked with the upper movable frame 5 by tie bars 67. Thus, as the upper movable frame 5 is lowered, the conveyor 63 will be lowered from a position illustrated in FIG. 4 to retract the belts 62 below the upper surface of the elements 58–61. This arrangement allows the belts 62 to convey a batch into the desired position above the tables of the lower frame, then as the upper frame 5 is lowered to grip the batch, the belts of the conveyor 63 are retracted so they do not interfere with the severing operation.

It should be noted that the pressure plate 64 (FIG. 3) is provided with a covering 7 while each of the members 58–61 are covered with a covering layer 69. The covering layers 69 and 70 are preferably an elastomer and insure a proper gripping of the batch of sheets during the process.

Figure 4:
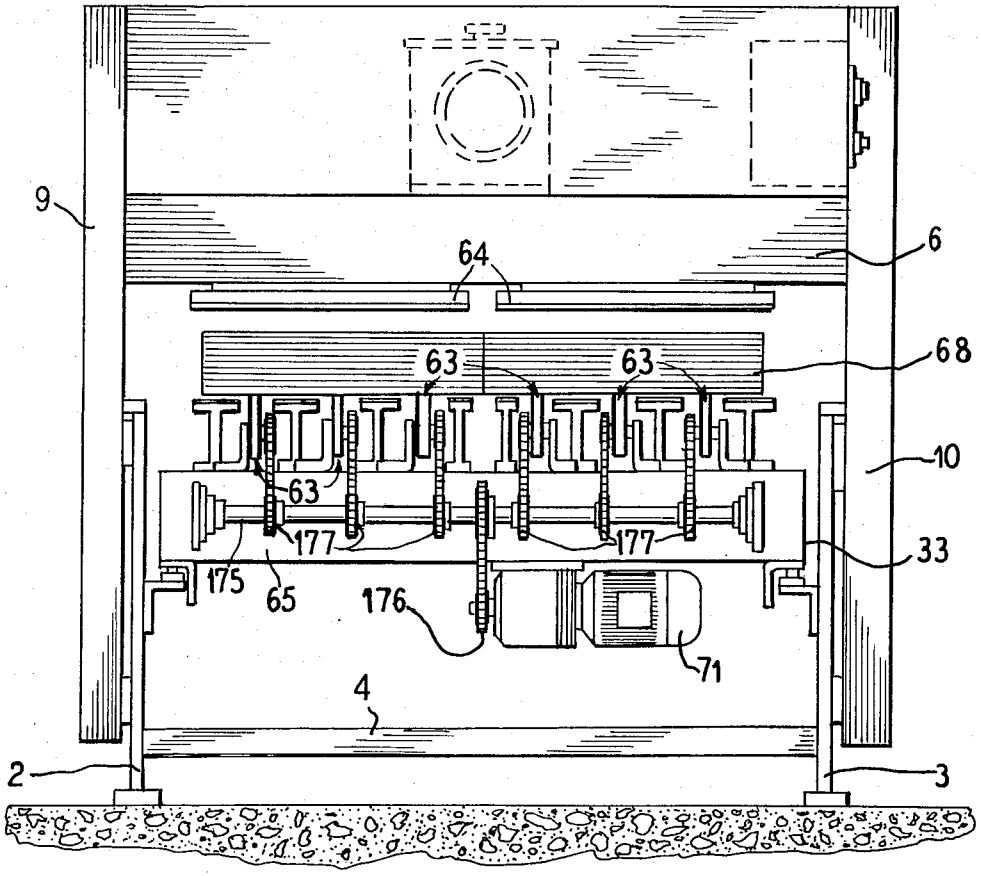
FIG. 4 is an end view of the device taken from the direction of arrow A in FIG. 1.

As illustrated in FIG. 4, the conveyor 63 is driven by a motor 71 which is commanded according to the required shifting of the batch of sheets 68 which is to be processed. The motion of the motor 71 is transmitted to a transverse shaft 175 by means of a chain drive 176. Each of the conveyor belts 62 of the conveyor 63 is then driven from the transverse shaft 175 by chains such as 177. The driving of the motor 71 will be controlled by an electrical cell 72 which transmits the detected information to the device (not shown) generating the operating cycle of the various members of the machine.

Figure 5:
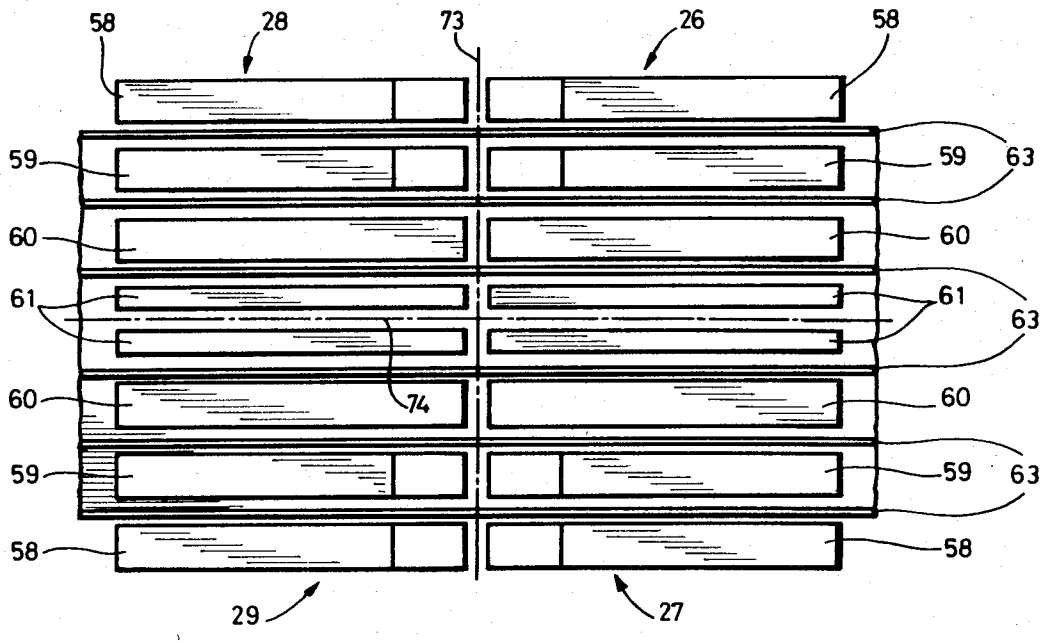
FIG. 5 is a partial plan view of the lower frame portion of the device of FIG. 1 taken from a position of arrow B.

As best illustrated in FIG. 5, the arrangement of the transverse elements 58–61 on each of the tables 26–29 enables severing a batch of blanks such as 68 along two orthogonal axes 73 and 74. Thus, in operation, a batch of blanks is positioned with the severing line of the blanks in the batch lying on the two axes 73 or 74. Then the upper frame is lowered by actuation of the pistons 30 and 31 to clamp the batch 68 between the longitudinal members 58–61 of the lower frame and the pressure plates 64 on the tables of the movable upper frame. The lowering of the upper frame will withdraw or retract the conveyors so that they are out of the way. Subsequently, the pistons are actuated in both the upper and lower frames to move the sliding plate and the movable tables in a desired sequence to obtain severing of the blanks in the batch from the other blanks. Subsequent to the operation, the upper frame 5 is elevated by the pistons 30 and 31 and the severed blanks of the batch are then engaged by the conveyor 63 and transported such as in the direction 42 to be removed from the device.

FIGS. 6*a* and 6*b* show an operation for processing a batch of sheets with each sheet having six blanks 75, 76, 77, 78, 79 and 80. To start the process, the batch is transported into the device with the blanks 77–80 being positioned over the movable tables 26–29. Then the upper frame member is lowered to clamp the blanks 77–80 of the batch. After the batch has been clamped, pressure is applied to the cylinders so that only the coacting sliding plates 24 and their movable tables 26 and 27 are moved. This will tear the blanks such as 79 and 80 from the remaining blanks which form a batch 81 and after moving in a direction such as 83, the two tables move away from each other in order to effect a general movement in the direction of the arrows 82. If the sliding plate 24 and its two movable tables 26 and 27 are moved simultaneously, then a simultaneous severing of the two batches of blanks 79 and 80 from the others will occur. The pressure is then released after the severing operation and the batch of blanks 81 as well as the severed batches of blanks 79 and 80 are then shifted in the direction of arrow 83 by the conveyor such as 63 just enough to position the blanks 75–78 over or between the coacting movable tables 26–29 as illustrated in FIG. 6*b*. The two severed groups of blanks 79 and 80 are removed from the device. After being positioned as illustrated in FIG. 6*b*, the blanks of the batch are clamped by lowering the upper frame and then by moving the tables 26–29 as well as the sliding plate 24, a severing action will occur in the direction of arrows 84 and 85. The arrow 85 indicates a resulting direction given by shifting of the movable tables 26 and 27 along the arrow 84 as the sliding plate 24 is shifted in the direction 83. After the tearing-off motion, all the blanks 75–78 are removed as piles of separate blanks from the severing device. As noted hereinabove, the originally severed piles of blanks 78 and 80 can be removed prior to separating the other blanks.

Another configuration for the blanks is illustrated in FIGS. 7*a*, 7*b* and 7*c*. The blank sheet 86 comprises four blanks 87, 88, 89 and 90. It is noted that each of these blanks extends the whole width of the sheet 86 which forms the batch. Thus, a single stripping operation following in the direction of arrow 91 occurs. The batch of sheets 86 are positioned with the lines separating the blanks 89 and 90 being positioned in the space between the slidable plate 24 and the fixed plate 25. After clamping by lowering the upper frame, the sliding plate 24 is shifted in a direction 91 to cause a severing operation and it is noted that the movable tables 26–29 are not moved laterally. After severing the first stack of blanks 90, the remaining blanks are unclamped and shifted in a direction 91 so that a severing of the blank 89 from the blank 88 will occur. After this has happened, the remaining blanks are shifted another step so that the blank 88 can be severed from the remaining blank 87.

In FIGS. 8*a*–8*c*, a pile of sheets 92 having eight blanks 93–100 is illustrated. In the first operation, the stack of blanks 92 are positioned so that the blanks 99 and 100 can be severed from the remaining blanks. After clamping, the movable tables 26 and 27 as well as the sliding plate 24 are shifted to create a movement in the direction of the arrows 101. Movement in the direction of the arrows 101 will sever the pile containing blanks 99 and 100 from the remaining batch. Then, the conveyor shifts the batch 92 and the severed piles of the blanks 99 and 100 in the direction of arrow 102 so that the next two blanks such as 97 and 98 can be removed from the group by being moved after clamping in the direction of arrow 101. After these two have been severed and the blanks have been unclamped, the conveyor moves the remaining blanks plus the two piles in the direction of arrow 103 so that the remaining four blanks of the partially severed pile are positioned over the tables 26–29. Then the four movable tables 26–29 are shifted in a direction shown by the arrows 104 and 105 which shifting also includes shifting the shiftable plate 24. This will sever the remaining four blanks into four separate piles which after being released by the clamping arrangement can be removed.

The device described hereinabove has the advantage to execute the severing operation of the blanks of a pile of sheet without any deviation with regard to their transport direction. This method thus eliminates the drawbacks involved by rotating the rows of blanks during their severing operation and allows the suppression of additional severing stations.

Although various minor modifications may be suggested by those versed in the art, it should be understood that I wish to embody within the scope of the patent granted hereon, all such modifications as reasonably and properly come within the scope of my contribution to the art.

I claim:

1. A device for severing various blanks of a batch of die cut sheets, said device comprising a lower frame having side frame members interconnected by a lower transverse plate, a movable upper frame having an upper transverse plate interconnecting a side frame, means forming an articulate parallelogram for interconnecting the movable upper frame and guiding it during movement relative to the lower frame, means for raising and lowering the upper frame relative to the lower frame, said transverse lower plate supporting a fixed plate and a slidable plate, said transverse upper plate supporting a fixed plate aligned with the lower fixed plate and an upper slidable plate, each of said upper and lower fixed plates and slidable plates supporting movable tables arranged in pairs, means for moving the movable tables in a direction transverse to the axis of the frame, means for moving the slidable plates longitudinally in the frames and a conveyor disposed in the lower frame for transporting a stack in longitudinal direction of the device to be gripped between the movable tables as the upper frame is lowered onto the lower frame.

2. A device according to claim 1, wherein each of the movable tables disposed at the lower frame is provided with a plurality of laterally spaced longitudinally extending elements with each of the elements having a covering for engaging a surface of the batch.

3. A device according to claim 1, wherein each of the movable tables of the upper frame are provided with presser plates having a covering layer for engaging a surface of the batch.

4. A device according to claim 1, wherein each of the upper and lower transverse plates have tracks, each of the slidable plates having rollers engaging said tracks, and said means for shifting the sliding plate comprising a hydraulic jack.

5. A device according to claim 4, wherein the axis of the jack is offset from the center line of the slidable plate so that a slight canting of the plate occurs during shifting to create a tearing action.

6. A device according to claim 1, wherein each of the slidable plates has an aperture receiving a pair of tables, each of said movable tables having rollers engaging a surface of the slidable plate adjacent said aperture.

7. A device according to claim 1, wherein each of the fixed plates has an aperture, said movable tables being disposed in said aperture and having rollers engaging surfaces of the fixed plate adjacent said aperature.

8. A device according to claim 1, wherein the means moving the movable tables of the upper frame and the lower frame are hydraulic jacks having an axis, said jacks being mounted with the axis of the jacks being offset from the center line of said movable tables to create a canting of the tables during movement so that a tearing action is obtained.

9. A device according to claim 1, wherein each of the movable tables on the lower frame support a plurality of longitudinally extending laterally spaced elements, said conveying means comprising a plurality of belts, said belts extending between said longitudinal elements, said conveyor being mounted on a subframe connected to the upper frame so that as the upper frame is lowered to clamp a stack between the movable tables, said conveyor belts are withdrawn below the upper surfaces of the longitudinal elements.

* * * * *